United States Patent [19]

Stoner

[11] 4,269,108

[45] May 26, 1981

[54] PROGRAMMED SHELL CASING EJECTOR APPARATUS FOR AUTOMATIC CANNON

[75] Inventor: Eugene M. Stoner, Stuart, Fla.

[73] Assignee: ARES, Inc., Port Clinton, Ohio

[21] Appl. No.: 24,184

[22] Filed: Mar. 27, 1979

[51] Int. Cl.[3] ..... F41D 11/00

[52] U.S. Cl. ..... 89/33 R; 42/25

[58] Field of Search ..... 42/25; 89/33 R

[56] References Cited

U.S. PATENT DOCUMENTS 2,710,477 6/1955 Simpson ..... 42/25

FOREIGN PATENT DOCUMENTS 531992 1/1941 United Kingdom ..... 42/25

746227 3/1956 United Kingdom ..... 42/25

*Primary Examiner*—Stephen C. Bentley

*Attorney, Agent, or Firm*—Allan R. Fowler

[57] ABSTRACT

A programmed shell casing ejector apparatus, for an automatic cannon having an axially reciprocating bolt assembly, includes an ejector member axially slidably mounted to the bolt assembly, a pair of cam tracks symmetrically fixed to a cannon mount, and a corresponding pair of cam track followers pivotally mounted to the bolt assembly to engage the ejector member and, as the bolt assembly recoils, the cam tracks. Ejection through an ejection port of a fired shell casing, held to a bolt face by an extractor, is caused when the ejector member is moved forwardly relative to the recoiling bolt assembly by the cam track followers as the followers move along the cam tracks. Timing and velocity of the shell casing ejection is programmed, to prevent cannon malfunction or jamming due to improper ejection or casing damage, by configuring the cam tracks and followers so that the ejector member moves forwardly relative to the bolt assembly at controlled, increasing velocity preselected to be substantially less than recoil velocity of the bolt assembly.

14 Claims, 12 Drawing Figures

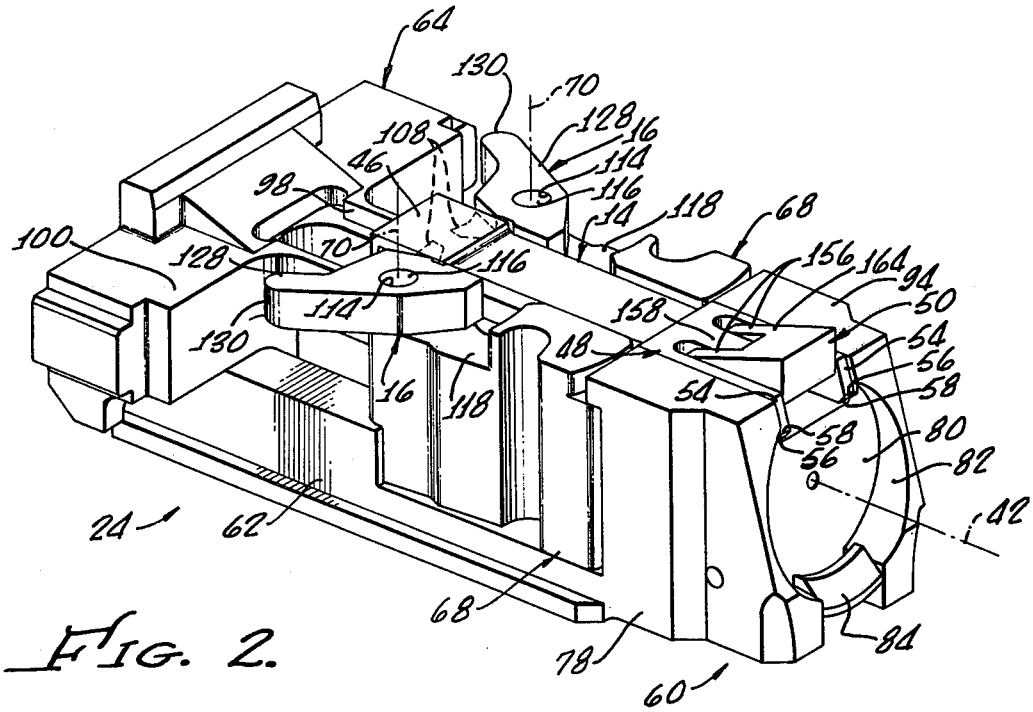
FIG. 2.
FIG. 4.
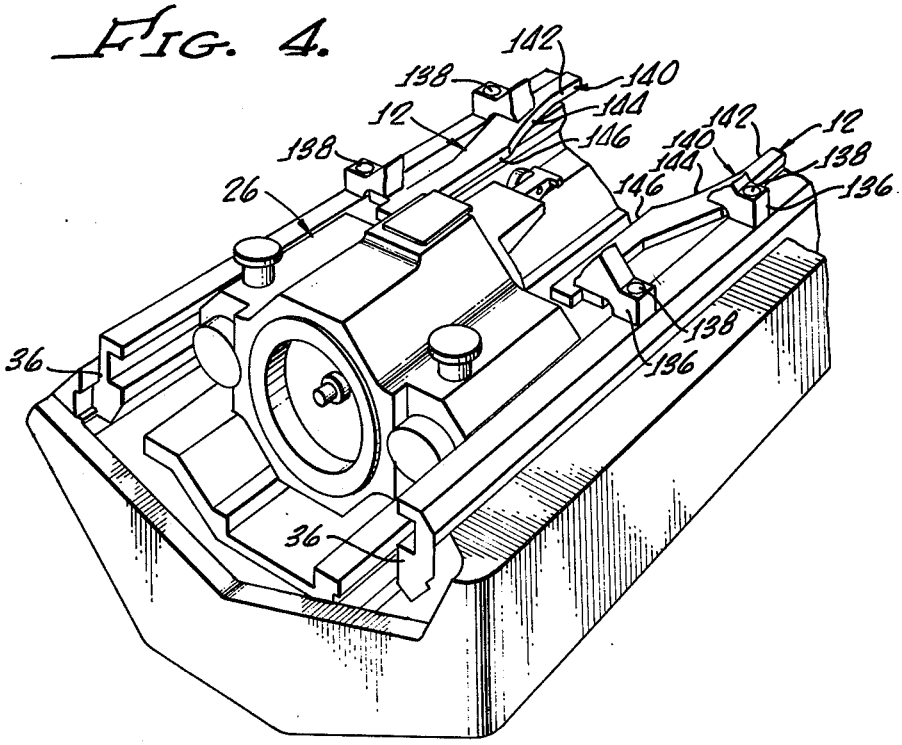

PROGRAMMED SHELL CASING EJECTOR APPARATUS FOR AUTOMATIC CANNON

The present invention relates to fired shell casing ejectors for automatic cannon and the like, and more particularly to types of such ejectors which substantially reduce ejector-casing impact damage and prevent erratic and unpredictable casing ejection.

Fast firing rates and very reliable operation are both essential for automatic cannon used in such critical applications as close-in air defense weapon systems. In attempting to attain high target hit probabilities, cannon performance improvements are continually necessary to adapt the systems to increasingly faster and more sophisticated aircraft targets which afford only brief tracking, and hence firing, times.

Close-in air defense weapons systems typically use a pair of single barrel, gas operated automatic cannon of 30–40 mm calibre. In such cannon, barrel gas pressure caused by firing is used to unlock a bolt assembly from the breech and drive both the bolt assembly and the just fired shell casing rearwardly towards a recoil buffer. During this recoil, an ejector apparatus causes the empty casing to be ejected from the cannon. The buffer stops bolt assembly recoil, and counterrecoils the assembly back towards the breech. On passing a shell supply port, a live or unfired shell is picked up by the counterrecoiling bolt assembly and driven forwardly into the breech for firing.

Firing rates of this type cannon are determined by bolt assembly cycling times, increased firing rates being generally achieved by reducing the cycling time. This is typically done by shortening the bolt assembly travel path between the breech and the buffer and/or by increasing average bolt assembly velocity over the cycling path.

In practice, however, many interrelated design problems must be overcome to increase the firing rate by even a small amount. As an illustration, when bolt velocities are increased, such problems are encountered as excessive mechanical stresses, reduced recoil buffer efficiencies, improper shell feeding and erratic shell casing ejection after firing. Solving any one of these problems may introduce or increase the magnitude of other problems.

Addressing specifically the casing ejection problems, as bolt recoil velocity is increased to increase firing rates, reliable and predictable shell ejection becomes very difficult, particularly in cannon in which the casings are relatively heavy. This difficulty causes faulty or unpredictable ejections which cause jammings or other cannon malfunctions.

Typically, a casing ejector assembly includes a bolt mounted ejector member which, as the bolt assembly recoils past an injection port, pushes the shell casing away from the bolt towards the port in response to the ejector member impacting a fixed part of the cannon.

When the bolt travel path is made very short to decrease bolt cycling time, the ejector port must also be shortened and must be positioned relatively near the recoil buffer. As a result, shell casings not only have a small opening through which they must be ejected, but also must be ejected sufficiently rapidly to avoid being hit by the bolt on counterrecoil. As a result, ejected casings tend to hit edges of the port and bounce back into the gun.

Furthermore, because of substantial recoil momentum of heavy shell casings, an abruptly stopped ejector member tends to cause considerable impact damage to the casings. Thus, at high casing recoil velocities, fragments punched by the ejector member from the impacted casing rim may be driven and lodge in parts of the cannon causing jamming or other malfunctions of the cannon. Alternatively, the ejector pin may deform the casing as the casing is pushed away from the bolt to such an extent that considerable ejection energy is lost. Consequently, ejection may be slow and the casing may not fully eject before the bolt assembly returns to the ejection position and the casing may be kicked back up into the cannon to cause jamming. Thus, as firing rates are increased by increasing bolt assembly recoil velocity and decreasing bolt assembly path length, malfunctions of the cannon attributable to faulty casing ejection also increase.

Because of the problems associated with ejecting relatively heavy shell casings, some large automatic cannon employ mechanical spring-type ejector buffers in attempts to reduce impact damage to the casings and thereby provide controlled ejection thereof. However, as is generally known, operation of mechanical springs at high impact velocities is unpredictable because separate coils or portions of the springs tend to function indepently. Also at very high velocity impact, heavy mechanical springs tend not to behave as a spring but as a non-compliant structure. Hence, undesirable rim punching or deformation may still occur and casing ejection is still erratic and uncontrolled.

For these and other reasons, improvements to shell casing ejection apparatus are required before firing rates of large automatic cannon can be substantially increased and before operational reliability even at existing firing rates can be significantly improved.

Thus, and particularly adapted for use in an automatic cannon or the like having an axially reciprocating bolt assembly with means for holding, after firing of the cannon, a fired shell casing to a forward face thereof, and having a shell ejection port located along the path of bolt assembly reciprocating travel, a programmed shell casing ejector, according to the present invention, comprises an ejector member having a shell base engaging portion and an actuation portion and means for mounting the ejector member to the bolt assembly for longitudinal movement relative thereto. Also included in the ejection apparatus are camming means for causing, as the bolt assembly travels rearwardly after firing of the cannon, the ejector member to move forwardly relative to the bolt assembly at a controlled and increasing velocity which is substantially less than rearward velocity of the bolt assembly. Accordingly, fired shell casings held to the bolt assembly face are impacted by the ejector member without significant impact damage and are hence ejected outwardly through the ejection port in a highly predictable and consistent manner.

More specifically, the camming means includes a pair of cam tracks and a corresponding pair of cam track followers. The cam tracks are symmetrically mounted to portions of the cannon which do not reciprocate with the bolt assembly, and are formed to provide a pair of laterally spaced apart camming surfaces having generally parallel, laterally spaced apart forward regions, generally parallel rearward regions which are laterally spaced more closely together than are the forward regions. Inwardly converging intermediate regions of the camming surfaces interconnect the forward and rearward regions thereof.

Pivotally mounted to the bolt assembly, also in a symmetrical manner, the cam followers each have a first, ejector member engaging portion and a second portion which engages a corresponding one of the camming surfaces when the bolt assembly recoils towards a casing ejection position.

Configuration of the camming surfaces intermediate regions is such as to cause, as the bolt assembly recoils rearwardly, the cam follower second portions to remain in engagement with such camming surface regions without bouncing. As the cam follower second portions move along the camming surface intermediate regions, the cam followers are caused to pivot about mounting axes on the bolt carrier. This cam follower pivoting causes the cam follower second portions to move the ejector member shell base engaging portion forwardly, relative to the bolt assembly, from a first position, in which the ejector member shell base engaging portion does not extend forwardly of the bolt assembly forward face, to a second position, in which the engaging portion projects substantially forwardly of the bolt assembly face to engage, and hence cause ejection of, a fired shell casing. A shell base engaging face of the ejector member is formed in wedge shape to have edge contact with the shell casing base. This ejection member edge cuts slightly into the casing base to present slipping up of the casing during ejection.

Pivotally mounted to a forward region of the ejector member is a shell pick up element adapted for engaging a base portion of an unfired shell at a shell loading position upon forward movement of the bolt assembly therepast and for thereby stripping the shell forwardly from the loading position to enable shell loading and firing. The pick up element pivots between an extended, shell pick up position and a retracted, shell clearance position. Biasing means urge the element to the pick up position while permitting movement to the retracted position so that the bolt assembly can move rearwardly beneath a shell in the loading position. Sloped upper regions of the ejector member casing engaging surface function as a ramp to guide the base of the picked up shell downwardly towards a barrel bore axis.

A better understanding of the present invention may be had from a consideration of the following detailed description, taking in conjunction with the accompanying drawings in which:

FIG. 2 is a detailed perspective view of the bolt assembly of FIG. 1, showing portions of the programmed ejector apparatus including an ejector member slidably mounted on the bolt assembly and a pair of cam track followers pivotally mounted to the bolt assembly;

FIG. 4 is a broken away perspective view, showing cam track portions of the ejector apparatus fixed to an associated cannon mount and having a pair of laterally spaced, contoured camming surfaces of the cam track portions for guiding the cam followers;

Figure 12:
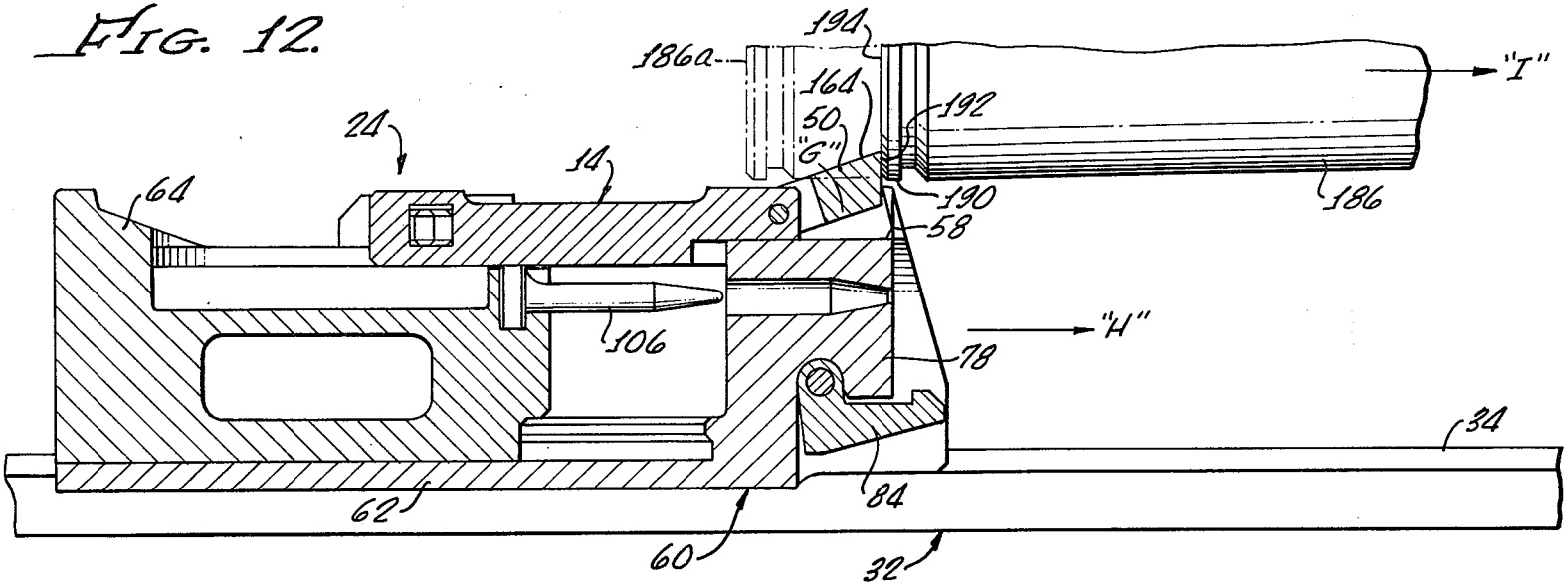
Figure 11:
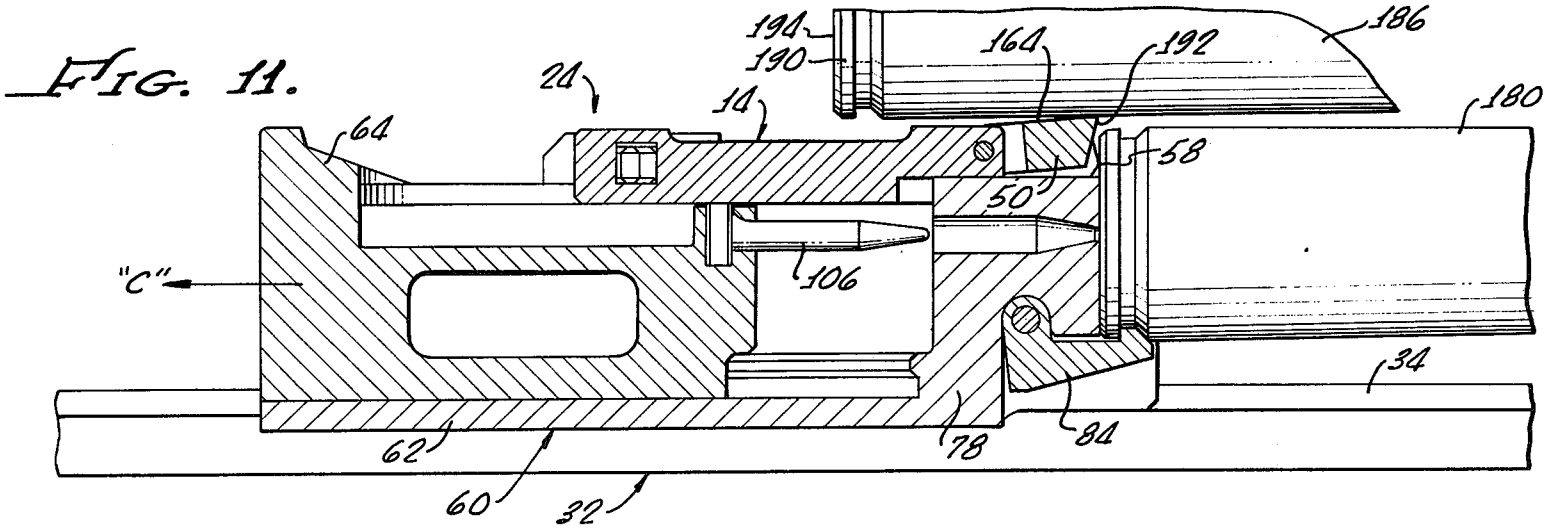

FIG. 11 is a vertical sectional view, showing an ejector member mounted shell pick up element in a retracted position enabling recoil movement of the bolt assembly under an unfired shell in a loading position; and FIG. 12 is a vertical sectional view, showing the shell pick up element in a position for engaging and stripping an unfired shell from the shell loading position as the bolt assembly moves forwardly in counterrecoil.

Figure 1:
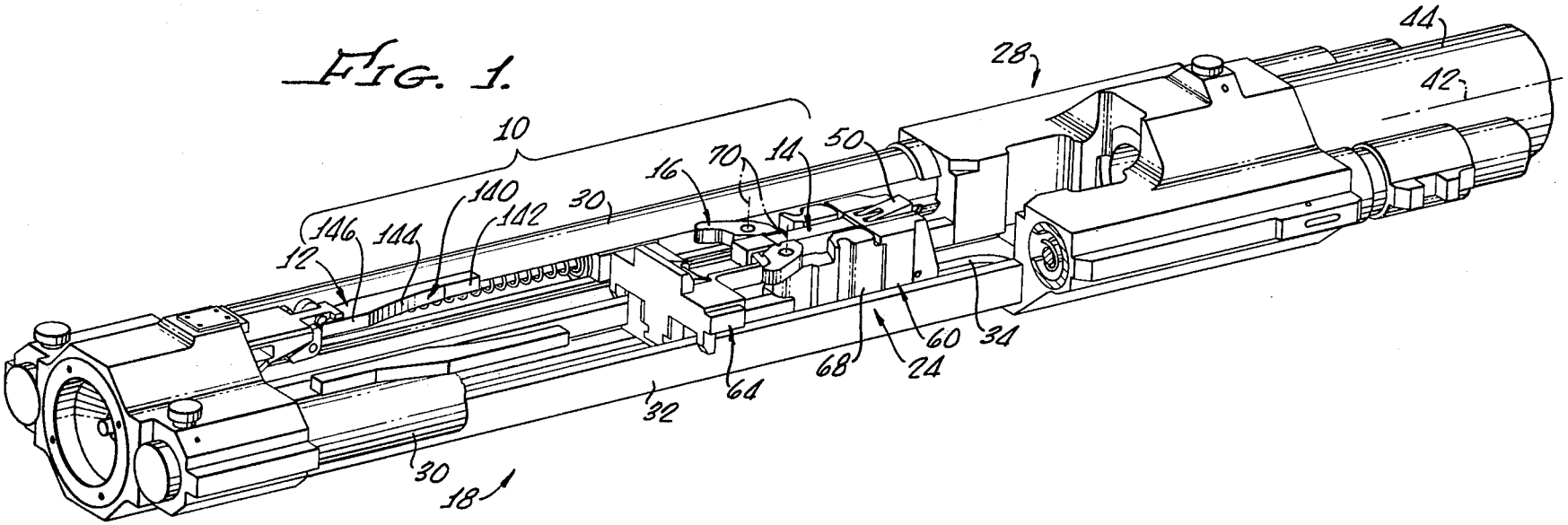
FIG. 1 is a partially cutaway perspective view of an automatic cannon having associated therewith a programmed ejector apparatus according to the present invention.
Figure 10:
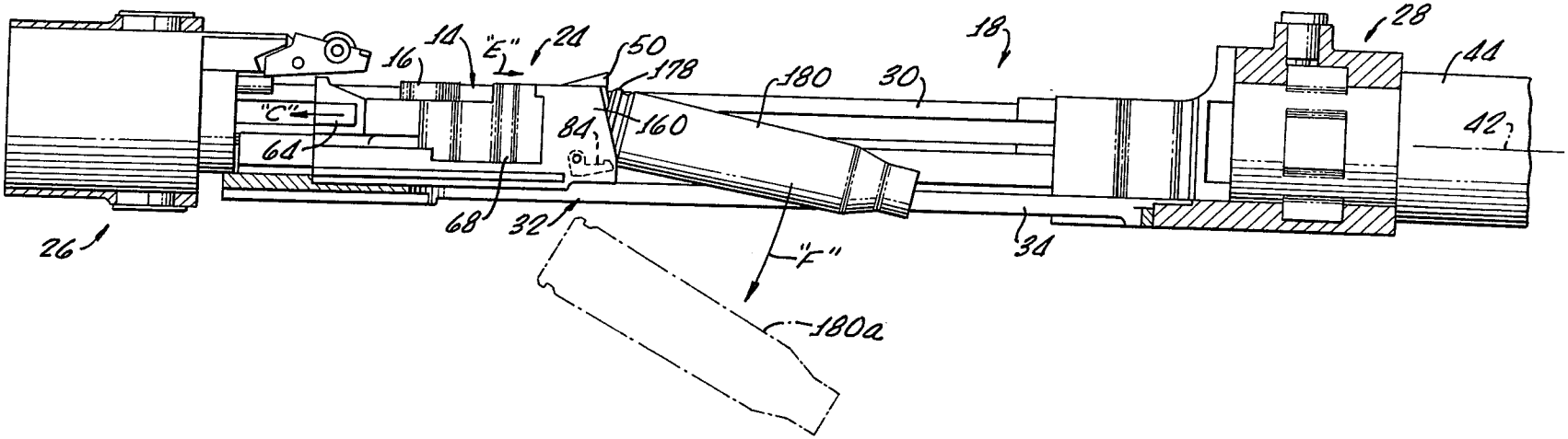
FIG. 10 is an elevational view, in cross-section, corresponding in time to FIG. 9, showing the cam followers along the rearward camming surface regions, complete forward extension of the ejector member and a shell casing being ejected downwardly through the ejection port.

As seen in FIG. 1, a programmed shell casing ejector apparatus 10, according to the present invention, comprises generally a laterally spaced pair of cam tracks 12, an ejector member 14 and a pair of cam followers 16 which cooperate with the cam tracks to operate the ejector member, as more particularly described below.

Also shown in FIG. 1, for illustrative purposes, is an automatic cannon 18 with which the ejector apparatus 10 is operatively associated. Although the cannon 18 may be virtually any type of automatic cannon or gun which operates on an axially reciprocating bolt principle, the particular cannon shown is of the open-framework receiver type described in U.S. patent application, Ser. No. 024,186, filed on even date herewith.

Pertinent parts of the cannon 18, that is, those parts associated in some manner with operation of the ejector apparatus, include a bolt assembly 24 to which the ejector member 14 and cam followers 16 are mounted, a combination bolt recoil and sear buffer 26 and a breech ring 28. Guiding reciprocating movement of the bolt assembly 24 between the breech ring 28 and the buffer 26 is a laterally spaced apart pair of support tubes 30 which also mount the buffer relative to the breech ring. Further guiding and support of the bolt assembly 24 is provided by a plate 32 which extends between the breech ring 28 and buffer 26 which is formed having an axially elongated shell casing ejection port 34.

The cannon 18 is mounted to mounting means 36, to which the cam tracks 12 are fixed, in a symmetrical manner about a bore axis 42 of a cannon barrel 44, as more particularly described below.

Figure 3:
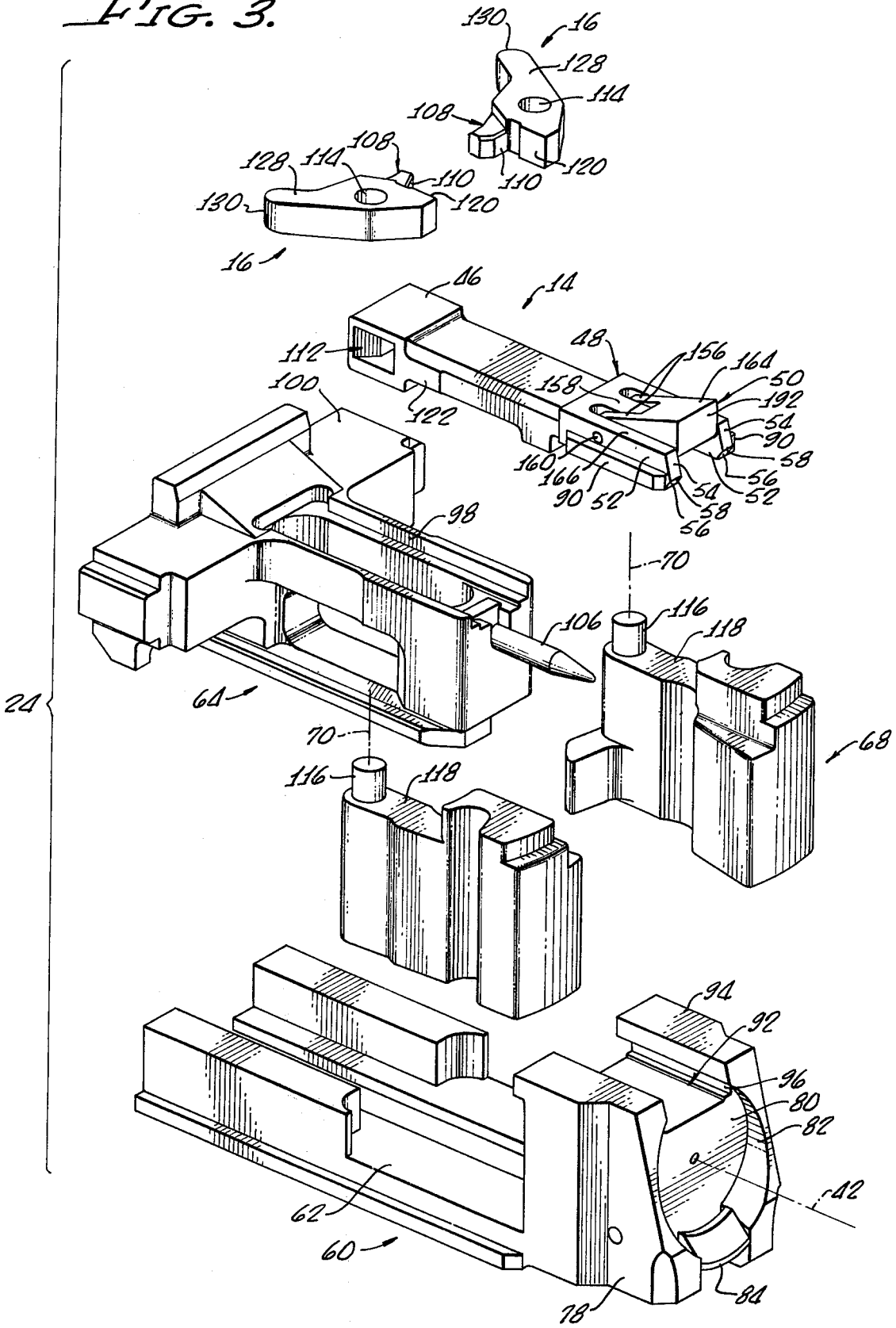
FIG. 3 is an exploded view of the assembly of FIG. 2, showing features of the ejector member and cam followers and related portions of the bolt assembly.

More particularly, as seen in FIGS. 2 and 3 (which show the bolt assembly 24 in assembled and exploded form), the ejector member 12, formed generally in axially elongate bar form with a rectangular cross-section, has a rearward, actuation portion 46 and a forward, shell casing engaging portion 48. To enable mounting of a shell pick up element 50, for below described purposes, the ejector member shell engaging portion 48 is formed having a pair of laterally spaced, forwardly projecting ears 52. Formed on a forward end of each of the ears 52 is a wedge shaped surface comprising an upper surface region 54 and a lower surface region 56 which are slanted rearwardly to define an intersection or impact edge 58. During ejection impact, as more fully described below, the casing line contact by the edge 58 maintains appropriate casing position during at least initial ejection stages.

As seen in FIGS. 2 and 3, the bolt assembly 24, to which the ejector member 14 and cam followers are mounted, comprises generally an elongate, "L" shaped bolt 60, to a rearwardly extending portion 62 of which is mounted, for axial sliding movement relative thereto, a "T" shaped bolt carrier 64. Pivotally mounted to the rearwardly extending bolt portion 62 is a pair of bolt-breech ring locking lugs 68. Pivotal lug axes 70, which are in vertical planes to each side of the assembled carrier 64 and orthogonal to the barrel bore axis 42, also form pivotal axes for the cam followers 16, as described below.

Included in a bolt forward portion 78, at a forward face 80 thereof, is a downwardly extending shell base receiving recess 82, a lower region of which communicates with a generally conventional shell casing extractor 84. Such extractor 84 in addition to assisting shell casing extraction from the breech ring 28 also holds an extracted shell casing in the recess 82 and to the bolt face 80 until ejection. In addition and importantly, the extractor 84 provides a pivoting point for the shell casing during the below described operation.

Mounting of the ejector member 14 to the bolt assembly 24, for required axial sliding movement relative thereto, is enabled by a pair of longitudinal lugs of rails 90 formed along lower outer regions of the ears 52 in a symmetrical manner. To receive the shell casing engaging portion 48 of the member 14, including the ears 52 and the rails 90, a longitudinal T-shaped slot 92 is formed downwardly into the bolt forward portion 78 from an upper surface 94 thereof, about a vertical plane of symmetry through the bore axis 42. Side regions 96 of the slot 92 are configured for receiving the ejector member rails 90.

Longitudinal movement of the ejector member 14, relative to the bolt assembly 24, is further guided by an elongate slot 98 formed downwardly into the bolt carrier 64 from an upper surface 100 thereof. On assembly, lower rearward regions of the ejector member are received downwardly into such slot 98. During ejector operation, the bolt slot 92 and the bolt carrier slot 98 guide movement of the ejector member 14 between a first, rearward position, relative to the bolt assembly 24, in which the ejector-casing impact edge 58 is flush with, or slightly rearwardly of, the bolt face 80 and a second, forwardmost ejection position in which such impact edge is substantially forwardly of the bolt face, as more particularly described below.

To prevent impact absorbing damage, other than that necessary to maintain casing alignment, to bases of shell casings being ejected by the ejector member 14, and to enable consistent and predictable casing ejection through the ejection port 34, the cam tracks 12 and cam followers 16 are configured to move the ejector member forwardly, relative to the recoiling bolt assembly, from the first to the second positions in a precisely predetermined and controlled manner.

It should be understood that although for ease and clarity of discription the ejector member 14 is herein generally described as being moved forwardly (towards the breech ring 28) relative to the bolt assembly 24, what actually occurs is that the bolt assembly moves rearwardly relative to the ejector member. That is, after firing, the bolt assembly 24, the ejector member 14 and an extracted shell casing are all recoiled rearwardly towards the buffer 26 together at the same velocity. At an ejection position the ejector member 14 is slowed down in a controlled manner so that the bolt assembly moves rearwardly at greater velocity beneath the member. Consequently the member 14 "moves forwardly" beyond the bolt face 80 to cause shell casing ejection.

By providing cam controlled or "programmed" slowing of the ejector member 14 during ejection, forward velocity of the ejector member relative to the bolt assembly 24 can be preprogrammed, by appropriate design of the cam tracks 12 and cam followers 16, in substantially any manner required to achieve consistently good casing ejection for the particular type cannon involved.

As an example, for the particular type cannon 18 illustrated, it has been found by actual firing that consistently good casing ejection is attained by constructing the cam followers 16 and the cam tracks 12 in a manner causing forward velocity of the ejector member 14, relative to the bolt assembly 24, to be substantially less than bolt assembly recoil velocity. In consequence, impact forces between the ejector member 14 and shell casings to be ejected are greatly reduced over those which would occur if recoil movement of the ejector member were abruptly stopped. Erratic and incomplete casing ejection as well as malfunctions caused by punched out casing particles are thus virtually eliminated.

Consistent shell casing ejection is further assured by relatively configuring the cam tracks 12 and the cam followers 16 so that no bouncing therebetween occurs during casing ejection. Eliminating such bouncing, by causing increasingly greater cam follower rotational velocity during casing ejection, with consequently increasing forward relative velocity of the ejector member 14 substantially reduces cam track and follower wear which, as extent of damage increases, would adversely affect casing ejection.

Since relative forward movement of the ejection member 14 is caused by the cam followers 16 moving rearwardly along the cam tracks 12, rearward velocity of the cam follower pivotal axes 70 relative to the cam tracks is an important factor in determining cam follower and track configurations. However this relative velocity of the cam follower axes 70 depends not only upon recoil velocity of the bolt 60 to which the cam followers 16 are pivotally mounted but also upon any other relative movement between the bolt and the cam tracks 12 during ejection. Consequently, unless the cam tracks 12 are mounted directly onto the cannon 18, recoil and/or counterrecoil velocity of the cannon at the time of casing ejection will add to, or subtract from, bolt assembly recoil velocity. This effect must be considered in determining relative velocity between the cam follower axes 70 and the cam tracks 12 for configuration design purposes, as described below.

Configuration of the cam followers 16 is determined, in part, by configuration of the bolt 60 or the bolt assembly 24, location at the pivotal axes 70, configuration of the ejector member 14 and constraints on locating the cam tracks 12. This follows from the requirement that the cam followers 16 must engage the cam tracks 12 and the ejector member 14 during casing ejection.

For the particular type of bolt assembly 24 illustrated, in which the bolt carrier 64 slides forwardly relative to the bolt 60 to move the locking lugs 68 out into mating breech ring recesses 104 (FIG. 1), and to cause shell firing by a firing pin 106, the cam followers 16 are generally triangular in outline (FIGS. 2 and 3). Each cam follower 16 has a first, ejector member engaging arm 108 which is directed generally inwardly towards the barrel bore axis 42 when the engaged ejector member 14 is in the first, rearward position (FIG. 2). Each of the first arms 108 is formed having an outwardly and forwardly directed ejector member actuation face 110. Corresponding outwardly opening, rectangular recesses 112, formed on opposite sides of the ejector member actuation portion 45, receive inwardly projecting ends of the cam follower arms 108.

A vertical mounting aperture 114, formed generally centrally through each of the cam followers 16, enables mounting of the followers on cylindrical studs 116 projecting upwardly from upper surfaces 118 of the locking lugs 68. In this manner, the cam followers 16 and the locking lugs 68 have common pivotal axes 70. Rearward travel of the ejector member 14 is limited by abutting surfaces 120 on the cam followers 16 forwardly of the first arms 108 and corresponding side surface regions 122 on the ejector member actuation portion 46 forwardly of the recesses 112.

Engagement between the cam followers 16 and the cam tracks 12 is enabled by a rearwardly and outwardly projecting second, cam track engaging arm 128 of generally triangular shape on each of the cam followers. Arcuate cam track engaging surfaces 130 are formed at outer ends of the second arms 128.

As previously mentioned, exact configuration, including length, of first and second cam follower arms 108 and 128 depend upon relative mounting location of the cam tracks 12, the followers 16 and the ejector member 14 as well as required casing ejection characteristics.

Referring to FIG. 4, it can be seen that the cam tracks 12 are fixed to the cannon mounting means 36 by a pair of longitudinally spaced apart, transverse brackets 136 which are in turn fixed to the mounting means by bolts 138. For the type of cannon 18 illustrated, the brackets 136 may support other portions related to the cannon, such as a trigger module (not shown), in operative relationship therewith. Mounting is such that the cam tracks 12 are symmetrical about the barrel bore axes 42 and in a common plane thereabove.

Each of the cam tracks 12, which are axially elongate plates, have an inwardly (towards the bore axis 42) facing camming surface 140 positioned for engagement by a corresponding cam follower second arm surface 130 as the bolt assembly 24 recoils into casing ejection position. The opposing camming surfaces 140 are divided for purposes of description into forward, intermediate and rearward regions 142, 144, and 146, respectively.

Lateral spacing between the camming surface forward regions 142 is equal to, or slightly greater than, the distance between outermost regions of the cam follower surfaces 130 when the engaged ejector member 14 is in the first, rearward position. In this position, the cam followers 16 are in an extended rotational position. To allow for tolerances, wear and slight misalignments, the opposing camming surface regions 142 may be slightly forwardly diverging so that the cam followers 16 may enter the cam tracks 12 without interference.

Lateral separation of the parallel and opposing camming surface rearward regions 146 is substantially less than that of the forward regions 142. Such rearward separation is equal to lateral distance between outermost regions of the cam follower surfaces 130 with the engaged ejector member 14 in the second, forwardmost position relative to the bolt assembly 24; that is, when the cam followers 16 are pivoted to a retracted position. Length of the camming surface rearward regions 146, which extend rearwardly into proximity with the buffer 26, is sufficient to maintain the cam followers 16 in the retracted position during remaining bolt assembly recoil and until the bolt assembly 24 approaches a shell pick up position on counterrecoil.

Thus, complete pivotal movement of the cam followers 16 from the extended to the retracted positions, with consequent relative forward ejection movement of the ejector member 14 from the first to the second positions is caused as the cam follower second arm surfaces 130 rearwardly traverse the camming surface intermediate regions 144. Such camming surface regions 144 are accordingly configured to cause the required ejector member movement relative to the bolt assembly 24 and to prevent bouncing between the cam follower surfaces 130 and the surface regions 144.

Figures 5, 6:
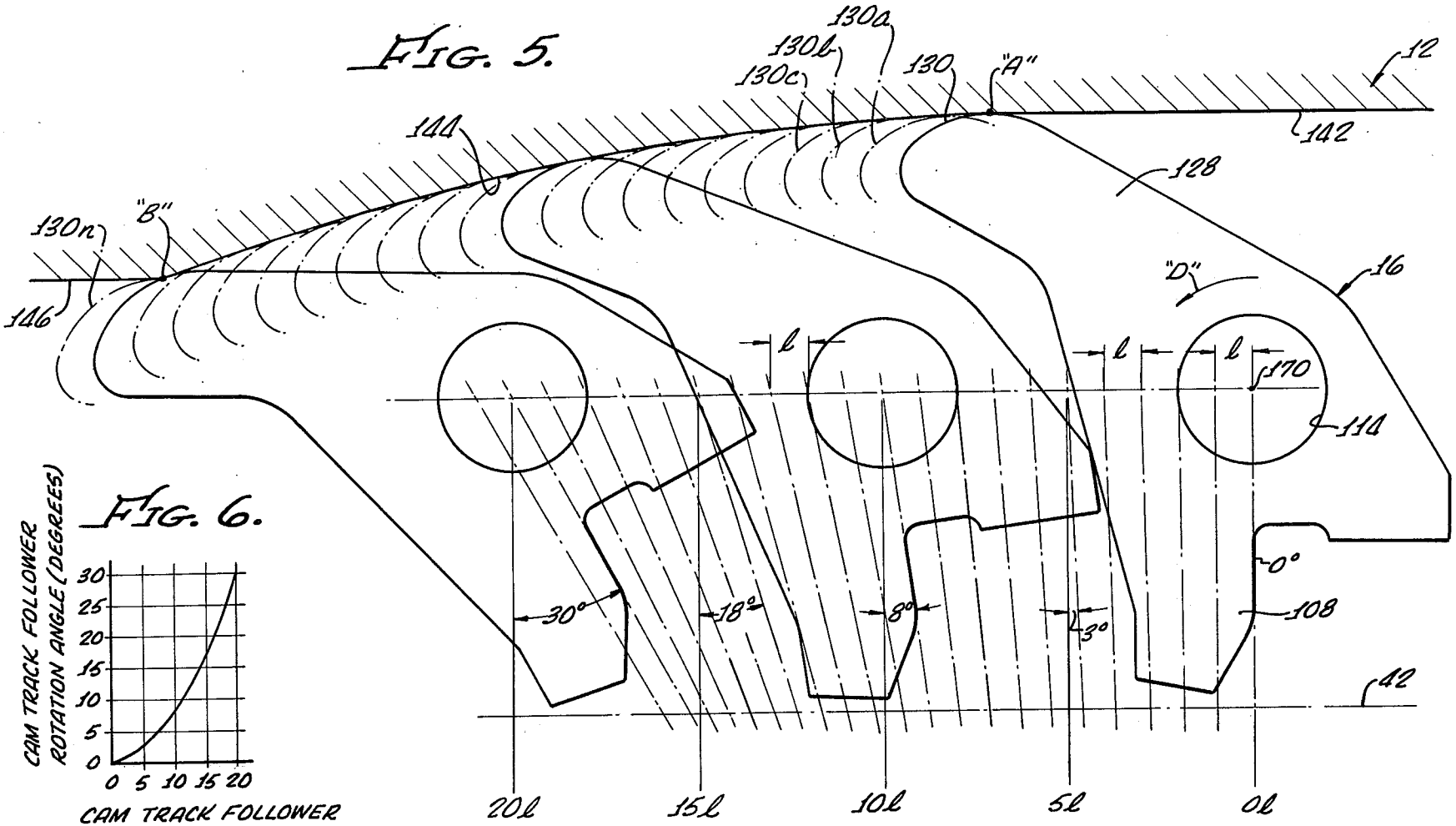
FIG. 5 is an outline representation of the cam track follower showing the sequential or stepwise manner in which camming surfaces contour is determined and constructed.
FIG. 6 is a graph in which is plotted angle of rotation of the cam track followers as a function of axial movement of the followers relative to the cam tracks.

As is shown in FIG. 5, contour of the camming surface intermediate regions 144, shown rearwardly extending between points "A" and "B", is established by plotting sequential rotational positions of the cam follower surfaces 130 (only one cam follower 16 being shown because of symmetry) as the cam followers axes 70 move rearwardly. As such axes 70 recoil in the direction of Arrow "C", the cam followers 16 are caused, by engagement between the cam follower surfaces 130 and the camming surface intermediate regions 144, to pivot inwardly in the direction of Arrow "D". To lay out the surface region 144, for each equal increment of rearward axes movement, "l", the cam follower is rotated a slightly greater angle in the direction of Arrow "D". A sequence of rotational positions of the surface 130—positions 130*a*, 130*b*, 130*c* . . . 130*n*—being thereby obtained. After such layout is complete, a smooth curve is drawn tangent to the surfaces 130, 130*a*, 130*b* . . . 130*n* to define the surface region 144.

FIG. 6 plots rotational angle of the cam followers 16 as a function of rearward displacement of the axes 70 in increments of "l" for the corresponding, exemplary layout of FIG. 5. Starting with 0° of cam follower rotation at zero "l", at 5 "l" the cam follower has been rotated through approximately 3°; at 10 "l", through about 8°; at 15 "l", through about 18° and at 20 "l" (representing complete rotational movement of the cam followers to cause shell ejection), through about 30°. This increasing angular displacement of the cam followers 16, which is clearly evident from FIG. 6, is consistent with the requirement that the cam followers are caused to pivot at increasing rotational velocity to maintain cam follower/cam track engagement without bouncing therebetween.

In the above described manner, the intermediate camming surface region 144 can be layed out for virtually any reasonable configuration of the cam followers 16, bolt assembly 24 and so forth, to provide required ejector member movement relative to the associated bolt assembly. Other variables which may require consideration in particular instances include shell casing weight, ejection port length and location, bolt assembly recoil and counterrecoil velocities and cannon recoil characteristics.

Use is also made of the ejector member 14 for mounting the shell pick up element 50 (FIGS. 2 and 3). A spaced apart pair of rearwardly extending ears 156 of the pick up element 50 are pivotally mounted to the ejector member ears 52 and an intermediate ejector member ear 158, by a pivot pin 160. Such mounting enables the element 50 to pivot between an upwardly extended, shell pick up position (shown in FIGS. 2 and 3) and a retracted position wherein an upper surface 164 of the element is flush with an upper surface 166 of the ejector member 14. A pair of longitudinally extending springs 170 (FIG. 7), through plungers 172, urge or bias the pick up element 50 to the extended pick up position while permitting the element to be depressed downwardly to the retracted position during recoil.

Function of the extended pick up element 50 is to strip, on bolt assembly counterrecoil from the buffer 26, above-the-bolt positioned shells from a feeder (not shown). Unfired shells are so positioned to be above the recoil path of the bolt assembly 24 and an extracted shell casing, assuming as is generally the case, that the shells may be moved to the feed position before ejection and recoil is complete. With the pick up element 50 retracted in response to engagement with a shell in the feed position, the bolt assembly 24 and the ejector member 14 can recoil beneath the shell without significant interference.

Alternatively, to avoid necessity for the pick up element 50, a shell to be fed could be dropped or pushed downwardly into the counterrecoil path of the bolt assembly 24 after full recoil thereof. However for fast firing cannon, the extremely short time interval between when the bolt assembly recoils beyond the shell and when the bolt assembly must pick up the shell on counterrecoil is too short for reliably moving a shell into the bolt assembly path. As a result, either shells are often moved down too soon and interfere with bolt assembly recoil and shell casing ejection or too late to be picked up.

In addition to providing convenient, exposed mounting for the pick up element 50, it is also to be appreciated that with suitable relative arrangement of the ejection apparatus 10 and shell feed portions of the cannon 18, the ejector member 14 can also be adapted for providing relatively "soft" shell pick up for some types of cannon. Soft shell pick up may be necessary to prevent shell impact damage and premature firing. To this end, it should be observed that if the cam followers 16 are still in engagement with the intermediate camming surface regions 144 during shell pick up, the ejector member 14, and hence the pick up element 50, move rearwardly relative to the bolt assembly. Accordingly, for such a cannon configuration, the result is that the pick up element 50 impacts a shell at a velocity substantially less than bolt counterrecoil velocity.

Operation of the Programmed Shell Casing Ejector Apparatus 10

Operation of the ejection apparatus 10 is generally apparent from the foregoing description. However, for illustrative purposes, several time interval steps in the shell casing ejection portion of the bolt assembly recoil/counterrecoil cycle are illustrated in FIGS. 7–10.

Figure 7:
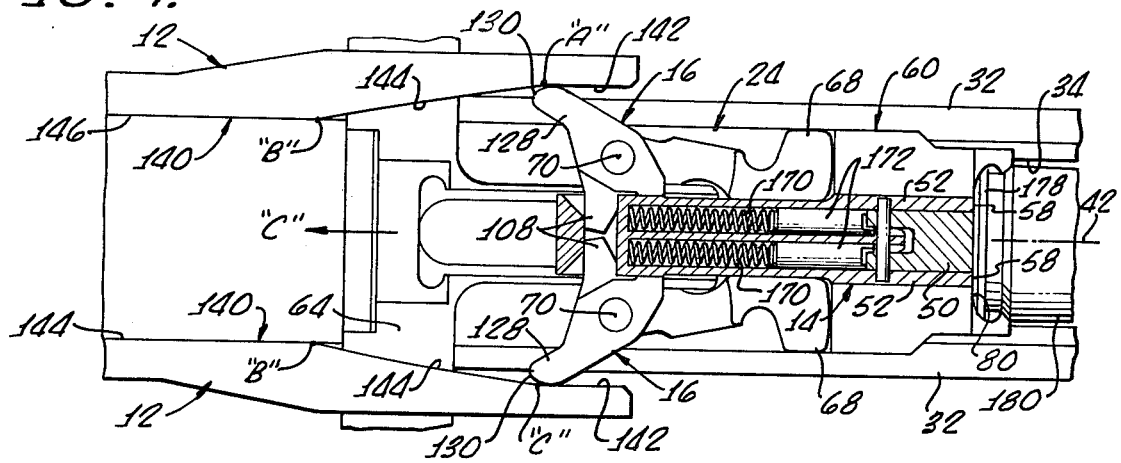
FIG. 7 is a plan view, partially in horizontal cross-section, of the assembly of FIG. 2 with the cam tracks added, showing the shell ejector cam followers inside forward portions of the cam tracks, and also showing a pair of springs and push rods which bias a shell pick up element mounted to the ejector member.

In FIG. 7 bolt assembly 24 is shown recoiling rearwardly (Arrow "C") after firing of the cannon, a base 178 of a fired shell casing 180 being held to the bolt face 80 by the extractor 84 (not shown). At the instant of FIG. 7, the cam followers 16 will have entered between the cam tracks 12, with the engagement arm surfaces 130 engaging the camming surface forward regions 142 forwardly of points "A" where the intermediate camming surface regions 144 start. At this instant, the cam followers 16 are still in a fully extended position with the ejector member 14 in the first, non-ejecting position and with the engagement edge 58 flush with, or slightly rearwardly of, the bolt face 80. Velocity of the ejector member 14 relative to the bolt assembly 24 is zero. That is, both are recoiling at the same velocity and ejection of the shell casing 180 has not been initiated.

Figure 8:
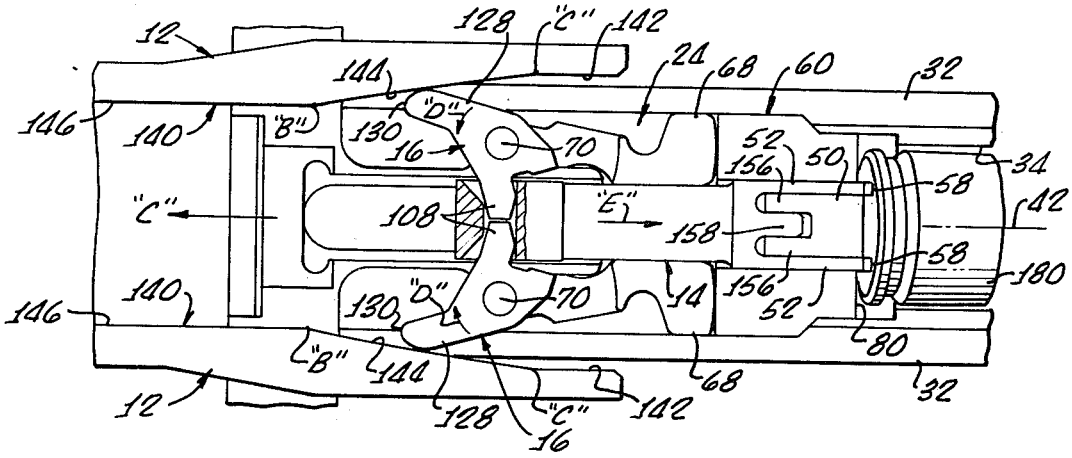
FIG. 8 is a plan view, similar to FIG. 7 but at an instant later, showing the cam followers engaging intermediate, inwardly converging regions of the camming surfaces and consequent pivoting of the cam followers to cause initial forward extending of the ejector member past a forward bolt face to initiate shell casing ejection.
Figure 9:
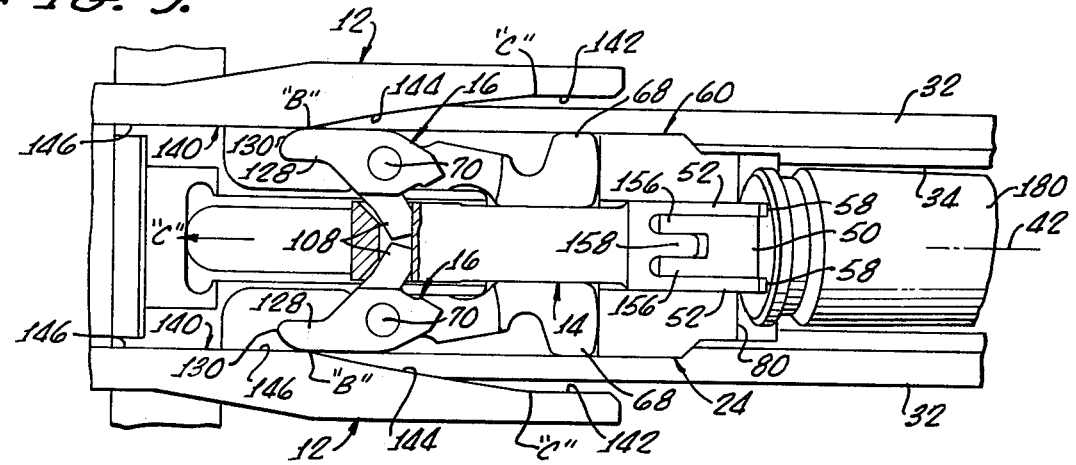
FIG. 9 is a plan view, similar to FIG. 8, but at an instant later, showing the cam followers now moving along rearward regions of the camming surfaces with consequent complete pivoting of the cam followers and forward extension of the ejector member relative to the bolt assembly, and showing the shell casing as it is driven away from the bolt assembly.

At the later instant of time depicted in FIG. 8, the cam follower first arm surfaces 130 have engaged, and are moving rearwardly along the camming surface intermediate regions 144. As a result of the convergence of such camming surface regions 144, the cam followers 16 are caused to rotate (in the direcion of Arrow "D") about the axes 70 to an intermediate position depicted. In response thereto, the ejector member 14 is moved forwardly (direction of Arrow "E") relative to the bolt assembly 24 into ejection engagement with the shell casing base 178. In this intermediate ejection position, the ejector member engaging edge 58 are forwardly of the bolt face 80 and, due to cutting slightly into the casing base 178, prevents the casing base from slipping upwardly out of full engagement by the extractor 84. Ejection rotation (direction of Arrow "F", FIG. 10) of the shell casing 180 about a hinge line created by the extractor 84 and through the ejection port 34 has started.

When the rearwardly traveling cam follower surfaces 130 pass point "B" on the camming surfaces 140 and start traversing the rearward regions 146 thereof (FIGS. 9 and 10) the cam followers 16 have been fully rotated or retracted inwardly. As a result, the ejector member 14 has been moved fully forwardly relative to the bolt assembly 24 (to the second position) and is again moving rearwardly at bolt recoil velocity.

However, rotational momentum already imparted to the shell casing 180 causes the casing to continue pivoting (Arrow "F", FIG. 10) about the extractor 84 and downwardly out through the bottom plate ejection port 34. As the casing 180 continues to rotate out through the port 34, the casing disengages from the extractor 84, which is spring loaded to permit pivotal movement, and is freely ejected from the cannon 18. For illustrative purposes, a free traveling ejected casing **180*a* is shown in phantom lines in FIG. 10**.

It is evident that since the camming action between the cam followers 16 and the cam tracks 12 relatively gradually slows recoil movement of the ejector member 14 relative to the casing 180, casing impact damage, including punching out portions of the shell casing base 178, is virtually eliminated.

"Softness" of the casing ejection can, for example, be varied by varying length and convergence angle of the camming surface intermediate regions 144. However, as length of the surface regions 144 is increased to provide softer casing ejection, ejection requires more time and the bolt assembly recoil path must be correspondingly lengthened thereby increasing cycling time and reducing firing rate. But to compensate for this, to maintain a given firing rate, recoil velocities must be increased, which in turn raises ejection impact. Thus, various trade offs are ordinarily required in configuring the apparatus 10.

Operation of the shell pick up element 50 is illustrated in FIGS. 11 and 12. In FIG. 11, the bolt assembly 24, the ejector member 14 and the extracted shell casing 180 are shown recoiling (direction of Arrow "C") together towards a shell ejection position. As the bolt assembly 24 recoils rearwardly under an unfired shell 186 located in an above-the-bolt feed position, the pick up element 50 is pushed downwardly by the shell against the springs 170 (not shown in FIGS. 11 and 12) to a flush, retracted position. Thus, the upper surface 164 of the pick up element 50 slides along an under side of the shell 186.

However, as soon as the element 50 recoils to a position rearwardly of a base portion 190 of the shell 186, the springs 170 pivot the element upwardly to a fully extended, pick up position, (direction of Arrow "G", FIG. 12).

In FIG. 12, the bolt assembly 24 with the ejector member 14 is shown an instant later in counter-recoil (direction of Arrow "H") from the buffer 26 (not shown). A forward face 192 of the upwardly pivoted pick up element 50 has impacted a base surface 194 of the unfired shell 186. As a result, the shell is driven forwardly (direction of Arrow "I") from an initial shell pick up position identified by a shell outline **186*a*** drawn in phantom lines.

During forward movement of the shell 186 with the bolt assembly 24 towards the breech ring 28, the picked up shell 186 may be guided downwardly into alignment with the bore axes 42 by guide means (not shown). When the shell 186 is so aligned, the shell base 190 is engaged, in a lower region, by the extractor 84; hence, the importance of not damaging such lower base regions when the shells are stripped from the pick up positions.

Although the ejector apparatus 10 has been discribed as being used in association with a gas operated cannon 18 in which shell casings are ejected during bolt assembly recoil, it is to be appreciated that the ejector apparatus can be used with other types of cannon which operate on a different type of reciprocating bolt assembly principle. For example, the apparatus 10 is adapted for use with mechanically driven, as opposed to gas driven, bolt assemblies, shell casing ejection occurring during bolt assembly rearward travel and unfired shell pickup occurring on forward bolt assembly travel.

Thus, although there has been described hereinabove a particular arrangement of a programmed shell ejector apparatus in accordance with the invention for the purpose of illustrating the manner in which the invention may be used to advantage, it will be appreciated that the invention is not limited thereto. Accordingly, any and all modifications, variations or equivalent arrangements which may occur to those skilled in the art, should be considered to be within the scope of the invention as defined in the appended claims.

What is claimed is:

1. In an automatic cannon having an axially reciprocating bolt assembly with extractor means operative for holding, during bolt assembly rearward travel after firing of the cannon, a fired shell casing to a forward face of the bolt assembly, and having a shell ejection opening located along the path of bolt assembly travel, programmed shell casing ejector apparatus, which comprises:

(a) an ejector member having a shell base engaging portion and an actuation portion;

(b) means for mounting the ejector member to the bolt assembly for axial movement relative thereto; and (c) ejector member camming means, including a relatively fixed cam track and an axially reciprocating cam track follower, configured for causing in response to the bolt assembly traveling rearwardly after firing of the cannon, the ejector member to move forwardly relative to the bolt assembly at a controlled velocity which is less than rearward velocity of the bolt assembly, a fired shell casing held to said bolt assembly face by the extractor means being ejected, in response to said relative forward movement of the ejector member, outwardly through the ejection opening in a controlled manner.

2. The programmed shell casing ejector apparatus according to claim 1, wherein a forward face of said shell base engaging portion is formed having upper and lower rearwardly sloping surface regions forming a shell base engaging edge at the intersection thereof, said engaging edge being operative for cutting into a base of a shell casing being ejected to prevent upward movement of the casing out of engagement with the extractor means.

3. In an automatic cannon having an axially reciprocating bolt assembly with extractor means operative for holding, during bolt assembly rearward travel after firing of the cannon, a fired shell casing to a forward face of the bolt assembly, and having a shell ejection opening located along the path of bolt assembly travel, a programmed shell casing ejector apparatus, which comprises:

(a) an ejector member having a shell base engaging portion and an actuation portion;

(b) means for mounting the ejector member to the bolt assembly for axial movement relative thereto; and (c) ejector member camming means, including an axially elongate, relatively fixed cam track and an axially reciprocating cam track follower operatively connected to the ejector member, for causing, in response to the bolt assembly traveling rearwardly after firing of the cannon, the ejector member to move forwardly relative to the bolt assembly at a predetermined, controlled velocity which is less than rearward velocity of the bolt assembly, a fired shell casing held to said bolt assembly face by the extractor means being ejected, in response to said relative forward movement of the ejector member, outwardly through the ejection opening in a controlled manner, said cam track and cam track follower having camming surfaces configured for causing the ejector member to move forwardly relative to the bolt assembly from a first position in which an ejector member shell base engaging portion is rearwardly of said bolt assembly face, to a second position in which said engaging portion projects forwardly beyond said bolt assembly face to engage and cause ejection of a fired shell casing held to the bolt assembly face by the extractor means.

4. In an automatic cannon having an axially reciprocating bolt assembly with extractor means operative for holding, during bolt assembly rearward travel after firing of the cannon, a fired shell casing to a forward face of the bolt assembly, and having a shell ejection opening located along the path of bolt assembly travel, a programmed shell casing ejector apparatus, which comprises:

(a) an ejector member having a shell base engaging portion and an actuation portion;

(b) means for mounting the ejector member to the bolt assembly for axial movement relative thereto; and (c) camming means for causing, as the bolt assembly travels rearward after firing of the cannon, the ejector member to move forwardly relative to the bolt assembly at a controlled velocity which is less than rearward velocity of the bolt assembly, a fired shell casing held to said bolt assembly face by the extractor means being ejected, in response to said relative forward movement of the ejector member, outwardly through the ejection opening in a controlled manner, said camming means including at least one cam track mounted to portions of the cannon which do not reciprocate with the bolt assembly and at least one cam track follower mounted on the bolt assembly and configured to have a first portion thereof in operative engagement with the ejector member actuation portion and a second portion thereof in engagement with the cam track as the bolt assembly moves rearwardly to a shell ejection position, said cam track and follower having cooperating camming surfaces configured for causing, as the bolt assembly moves rearwardly, the ejector member to move forwardly relative to the bolt assembly from a first position in which the ejector member shell base engaging portion is rearwardly of the bolt assembly face, to a second position in which said engaging portion projects forwardly beyond said bolt assembly face to engage and cause ejection of a fired shell casing held to the bolt assembly face by the extractor means.

5. In an automatic cannon having an axially reciprocating bolt assembly with extractor means operative for holding, during bolt assembly rearward travel after firing of the cannon, a fired shell casing to a forward face of the bolt assembly, and having a shell ejection opening located along the path of bolt assembly travel, a programmed shell casing ejector apparatus, which comprises:

(a) an ejector member having a shell base engaging portion and an actuation portion;

(b) means for mounting the ejector member to the bolt assembly for axial movement relative thereto; and (c) camming means for causing, as the bolt assembly travels rearward after firing of the cannon, the ejector member to move forwardly relative to the bolt assembly at a controlled velocity which is less than rearward velocity of the bolt assembly, a fired shell casing held to said bolt assembly face by the extractor means being ejected, in response to said relative forward movement of the ejector member, outwardly through the ejection opening in a controlled manner, said camming means including at least one cam track mounted to portions of the cannon which do not reciprocate with the bolt assembly and at least one cam track follower mounted on the bolt assembly and configured to have a first portion thereof in operative engagement with the ejector member actuation portion and a second portion thereof in engagement with the cam track when the bolt assembly moves rearwardly to a shell ejection position, said cam track follower being pivotally mounted to the bolt assembly and said cam track having a camming surface configured for causing, as the bolt assembly moves rearwardly with said follower second portion in engagement with said camming surface, the cam track follower to pivot in a manner causing the cam follower second portion to move the ejector member shell base engaging portion forwardly relative to the bolt assembly at increasing relative velocity, whereby engagement between the ejector member shell base engagement portion and a base portion of a fired shell casing being ejected is maintained during at least initial stages of casing ejection.

6. The apparatus according to claim 5, wherein said camming surface is further configured, relative to shape and pivotal mounting location of the cam follower, for causing substantially continuous contact between said camming surface and the cam track follower second portion during said relative forward movement of the ejector member shell base engaging portion, bouncing between the cam track follower second portion and said camming surface being thereby substantially prevented.

7. In an automatic cannon having an axially reciprocating bolt assembly with extractor means operative for holding, during bolt assembly rearward travel after firing of the cannon, a fired shell casing to a forward face of the bolt assembly, and having a shell ejection opening located along the path of bolt assembly travel, a programmed shell casing ejector apparatus, which comprises:

(a) an ejector member having a shell base engaging portion and an actuation portion;

(b) means for mounting the ejector member to the bolt assembly for axial movement relative thereto; and (c) camming means for causing, as the bolt assembly travels rearwardly after firing of the cannon, the ejector memeber to move forwardly relative to the bolt assembly at a controlled velocity which is less than rearward velocity of the bolt assembly, a fired shell casing held to said bolt assembly face by the extractor means being ejected, in response to said relative forward movement of the ejector member, outwardly through the ejection opening in a controlled manner, said camming means including a pair of laterally spaced apart, cam tracks having fixed to portions of the cannon which do not reciprocate with the bolt assembly, said cam tracks having opposing camming surfaces, said camming means further including a pair of laterally spaced apart cam track followers pivotally mounted to the bolt assembly, each of the cam track followers having camming surface engaging portion and an ejector member engaging portion, said cam tracks, camming surfaces and cam track followers being located symmetrically about a vertical plane of symmetry through a barrel bore axis.

8. The apparatus according to claim 7, wherein the camming surfaces are formed having generally parallel, laterally spaced apart forward regions, generally parallel rearward regions which are laterally spaced more closely together than are the forward regions, and inwardly converging intermediate regions which interconnect said forward and rearward regions, and wherein the cam followers are configured for causing the ejector member shell base engaging portion to move forwardly relative to the bolt assembly to cause shell casing ejection in response to the camming surface engaging portions of the cam followers moving rearwardly and inwardly in engagement with said camming surface intermediate regions.

9. The apparatus according to claim 8, wherein the camming surface engaging portion of each of the cam followers includes a cam following arm projecting outwardly from a pivotal mounting axis of the cam follower and wherein the ejector member engaging portion of each of the cam followers includes an ejector member engaging arm projecting inwardly from said pivotal mounting axis, movement of the cam following arms rearwardly and inwardly along said camming surface intermediate regions in response to rearward movement of the bolt assembly thereby causing pivotal movement of the cam followers about pivotal mounting axis thereof and relative forward movement of the ejector member to eject a shell casing held to a face of the bolt assembly by the extractor means.

10. In an automatic cannon having an axially reciprocating bolt assembly with extractor means operative for holding, during bolt assembly rearward travel after firing of the cannon, a fired shell casing to a forward face of the bolt assembly, and having a shell ejection opening located along the path of bolt assembly travel, a programmed shell casing ejector apparatus, which comprises:

(a) an ejector member having a shell base engaging portion and an actuation portion;

(b) means for mounting the ejector member to the bolt assembly for axial movement relative thereto;

(c) a pair of laterally spaced apart symmetrical cam tracks fixed to portions of the cannon which do not reciprocate with the bolt assembly, said cam tracks having opposing camming surfaces, said camming surfaces being formed having generally parallel, laterally spaced apart forward regions, generally parallel rearward regions which are laterally spaced more closely together than are the forward regions, and inwardly converging intermediate regions which interconnect said forward and rearward regions; and (d) a pair of laterally spaced apart, symmetrical cam track followers pivotally mounted to the bolt assembly in a symmetrical manner, each of the cam track followers having a camming surface engaging portion and an ejector member engaging portion, said camming surface engaging portion of each of the cam followers including a cam following arm projecting outwardly from a cam follower pivotal mounting axis and said ejector member engaging portion of each of the cam followers including an ejector member engaging arm projecting inwardly from said pivotal mounting axis, movement of the cam following arms rearwardly and inwardly in engagement with said camming surface intermediate regions in response to rearward movement of the bolt assembly thereby causing pivotal movement of the cam followers about pivotal mounting axes thereof and relative forward movement of the ejector member to eject a shell casing held to a face of the bolt assembly by the extractor means.

11. The apparatus according to claim 10, wherein said cam follower pivotal axes are parallel to each other and orthogonal to a barrel bore axis, wherein said cam following arms are configured to project generally outwardly away from the barrel bore axis and rearwardly from the pivotal axes when the ejector member shell base engaging portion is a rearward position relative to the bolt assembly, the cam following arms being caused to pivot generally inwardly towards the barrel bore axis in response to said cam following arms moving rearwardly and inwardly in engagement with the camming surface intermediate regions as the bolt assembly moves rearwardly, and wherein the ejector member engaging arms are configured to project generally inwardly toward the barrel bore axis when the ejector member is said relative rearward position, said ejector member engaging arms being caused to pivot generally forwardly in response to the cam following arms moving rearwardly and inwardly in engagement with the camming surface intermediate regions to thereby move the ejector member shell base engaging portion forwardly relative to the bolt assembly to a forward position causing ejection through the ejection port of a fired shell casing held to the bolt assembly face by said extractor means.

12. In an automatic cannon having a breech, an axially reciprocating bolt assembly with extractor means operative for holding, during bolt assembly rearward travel after firing of the cannon, a fired shell casing to a forward face of the bolt assembly, having a shell ejection opening located along the path of bolt assembly travel and having a shell loading position, a programmed shell casing ejector apparatus, which comprises:

(a) an ejector member having a shell base engaging portion and and actuation portion;

(b) means for mounting the ejector member to the bolt assembly for axial movement relative thereto;

(c) ejector member camming means, including a relatively fixed, axially elongate cam track and an axially reciprocating cam track follower operatively connected to the ejector member, for causing, in response to the bolt assembly traveling rearwardly after firing of the cannon, the ejector member to move forwardly relative to the bolt assembly at a predetermined, controlled velocity which is less than rearward velocity of the bolt assembly, a fired shell casing held to said bolt assembly face by the extractor means being ejected, in response to said relative forward movement of the ejector member, outwardly through the ejection opening in a controlled manner; and (d) shell pick up means mounted to a forward region of said ejector member, said shell pick up means being adapted for engaging a base portion of an unfired shell located in said shell loading position upon forward movement of the bolt assembly therepast and for stripping the unfired shell forwardly from said loading position towards said breech.

13. In an automatic cannon having a breech, an axially reciprocating bolt assembly with extractor means operative for holding, during bolt assembly rearward travel after firing of the cannon, a fired shell casing to a forward face of the bolt assembly, having a shell ejection opening located along the path of bolt assembly travel and having a shell loading position, a programmed shell casing ejector apparatus, which comprises:

(a) an ejector member having a shell base engaging portion and an actuation portion;

(b) means for mounting the ejector member to the bolt assembly for axial movement relative thereto;

(c) ejector member camming means, including a relatively fixed cam track and a cam track follower which axially reciprocates with the bolt assembly and which is in operative engagement with the ejector member, for causing, as the bolt assembly travels rearwardly after firing of the cannon, the ejector member to move forwardly relative to the bolt assembly at a predetermined, controlled velocity which is less than rearward velocity of the bolt assembly, a fired shell casing held to said bolt assembly face by the extractor means being ejected, in response to said relative forward movement of the ejector member, outwardly through the ejection opening in a controlled manner;

(d) a shell pickup element mounted to a forward region of said ejector member for pivoting between a first pivotal position in which a forward portion of said element projects upwardly substantially away from the ejector member for engaging a base of a shell located in said loading position for stripping the shell forwardly towards the breech, and a second pivotal position in which the forward portion of the element is retracted inwardly towards the ejector member; and (e) biasing means for urging the pick up element towards said first pivotal position while enabling the pick up element to pivot to the second position in response to the bolt assembly moving rearwardly under a shell located in the loading position.

14. In an automatic cannon having a breech, an axially reciprocating bolt assembly with extractor means operative for holding, during bolt assembly rearward travel after firing of the cannon, a fired shell casing to a forward face of the bolt assembly, having a shell ejection opening located along the path of bolt assembly travel and having a shell loading position, a programmed shell casing ejector apparatus, which comprises:

(a) an ejector member having a shell base engaging portion and an actuation portion;

(b) means for mounting the ejector member to the bolt assembly for axial movement relative thereto;

(c) camming means for causing, as the bolt assembly travels rearwardly after firing of the cannon, the ejector member to move forwardly relative to the bolt assembly at a controlled velocity which is less than rearward velocity of the bolt assembly, a fired shell casing held to said bolt assembly face by the extractor means being ejected, in response to said relative forward movement of the ejector member, outwardly through the ejection opening in a controlled manner; and (d) a shell pickup element mounted to a forward region of said ejector member for pivoting between a first pivotal position in which a forward portion of said element projects upwardly substantially away from the ejector member for engaging a base of a shell located in said loading position for stripping the shell forwardly towards the breech, and a second pivotal position in which the forward portion of the element is retracted inwardly towards the ejector member;

said ejector member shell base engaging portion being formed having a rearwardly sloped upper forward surface region and said pick up element being pivotally mounted to the ejector member in a position enabling said upper forward surface region to function as a ramp to guide movement of a shell stripped forwardly from said pick up position downwardly towards a barrel bore axis as the shell is moved forwardly; and (e) biasing means for urging the pick up element towards said first pivotal position while enabling the pick up element to pivot to the second position in response to the bolt assembly moving rearwardly under a shell located in the loading position.

* * * * *

UNITED STATES PATENT AND TRADEMARK OFFICE

CERTIFICATE OF CORRECTION

PATENT NO. : 4,269,108

DATED : May 26, 1981

INVENTOR(S) : Eugene M. Stoner

It is certified that error appears in the above-identified patent and that said Letters Patent are hereby corrected as shown below:

At column 1, line 57, replace "injection" with --ejection--

At column 6, line 61, after "relative" insert --rearward--

At column 7, line 8, replace "at" with --of--

At column 7, line 27, replace "45" with --46--

At column 7, line 28, after "follower" add --first--

At Claim 12, line 44, replace the second occurrence of "and" with --an--

Signed and Sealed this

*Eighth* Day of *December 1981*

[SEAL]

*Attest:*

GERALD J. MOSSINGHOFF

*Attesting Officer*

*Commissioner of Patents and Trademarks*